US008393014B1

(12) United States Patent
Follo

(10) Patent No.: US 8,393,014 B1
(45) Date of Patent: Mar. 12, 2013

(54) SWEAT ABSORPTION ASSEMBLY

(76) Inventor: Leonardo Follo, Freeport, NY (US)

( * ) Notice: Subject to any disclaimer, the term of this patent is extended or adjusted under 35 U.S.C. 154(b) by 0 days.

(21) Appl. No.: 13/239,593

(22) Filed: Sep. 22, 2011

(51) Int. Cl.
*A42B 3/10* (2006.01)

(52) U.S. Cl. ..... 2/181; 2/181.4

(58) Field of Classification Search ..... 2/18–420, 2/181, 181.4, 182.6, 414, 416; 24/562, 563, 24/499, 298; 40/329
See application file for complete search history.

(56) References Cited

U.S. PATENT DOCUMENTS

| | | | | |
|---|---|---|---|---|
| 1,484,042 | A * | 2/1924 | Smilie | 2/12 |
| 1,498,505 | A * | 6/1924 | Buchanan | 2/181 |
| 2,153,611 | A * | 4/1939 | Cavanagh | 40/329 |
| 2,248,366 | A * | 7/1941 | Lewis | 2/416 |
| 2,340,980 | A * | 2/1944 | Ostolaza et al. | 2/182.6 |
| 2,445,209 | A * | 7/1948 | Clark | 2/181.4 |
| 2,741,768 | A * | 4/1956 | Ruggiero | 2/416 |
| 2,813,270 | A * | 11/1957 | Barker, Jr. | 2/416 |
| 2,923,942 | A * | 2/1960 | Lee et al. | 2/418 |
| 3,046,559 | A * | 7/1962 | Cox et al. | 2/419 |
| 3,453,696 | A * | 7/1969 | Mates | 24/66.1 |
| D244,907 | S * | 7/1977 | Link | D8/395 |
| 4,403,366 | A * | 9/1983 | Lucke | 15/209.1 |
| 4,406,021 | A * | 9/1983 | Bloom | 2/181 |
| D281,710 | S * | 12/1985 | Kirby | D21/663 |
| D284,710 | S | 7/1986 | Hatchman | |
| 4,630,317 | A | 12/1986 | Brown et al. | |
| 4,642,817 | A | 2/1987 | Ferstenfeld | |
| D309,523 | S | 7/1990 | Martin | |
| 4,941,210 | A * | 7/1990 | Konucik | 2/171 |
| 4,953,770 | A * | 9/1990 | Bond, Sr. | 224/250 |
| 5,004,356 | A * | 4/1991 | Matsui | 383/63 |
| 5,025,504 | A * | 6/1991 | Benston et al. | 2/181.4 |
| 5,142,705 | A * | 9/1992 | Edwards | 2/418 |
| 5,426,790 | A * | 6/1995 | Robertson | 2/209.13 |
| D371,232 | S * | 7/1996 | Fleming | D2/853 |
| 5,553,326 | A * | 9/1996 | Moore | 2/181 |
| 5,613,248 | A * | 3/1997 | Young | 2/181.4 |
| 5,826,279 | A * | 10/1998 | Tencer | 2/181 |
| 5,901,381 | A * | 5/1999 | Nelson | 2/209.13 |
| 5,903,925 | A * | 5/1999 | Engebretson | 2/209.13 |
| 5,915,534 | A * | 6/1999 | May | 2/181.4 |
| 5,920,910 | A * | 7/1999 | Calvo | 2/181.4 |
| 6,467,095 | B1 * | 10/2002 | Nunnery | 2/181.6 |
| 6,477,715 | B2 * | 11/2002 | Shin | 2/181.4 |
| 6,694,526 | B1 * | 2/2004 | Tate | 2/209.12 |
| 6,718,559 | B1 * | 4/2004 | Davidson | 2/422 |
| 6,748,606 | B1 | 6/2004 | Silverstein | |
| 6,966,074 | B2 * | 11/2005 | Huh | 2/414 |
| D566,539 | S * | 4/2008 | Hicks | D8/395 |
| 7,941,870 | B2 * | 5/2011 | Kingto | 2/181.4 |
| 2005/0138719 | A1 * | 6/2005 | Huh | 2/416 |
| 2005/0193467 | A1 * | 9/2005 | Jung et al. | 2/169 |
| 2010/0058972 | A1 * | 3/2010 | Kinvi | 116/173 |
| 2010/0122399 | A1 * | 5/2010 | Odom | 2/181 |
| 2010/0132094 | A1 * | 6/2010 | Mullen | 2/410 |
| 2011/0247120 | A1 * | 10/2011 | Knoedler | 2/10 |

* cited by examiner

*Primary Examiner* — Shelley Self
*Assistant Examiner* — Richale Quinn

(57) ABSTRACT

A sweat absorption assembly for protecting headwear from sweat includes a clip that is configured to receive a sweatband of a baseball cap. A mount is removably coupled to the clip. An absorbing member is elongated and is positionable on the mount.

3 Claims, 4 Drawing Sheets

SWEAT ABSORPTION ASSEMBLY

BACKGROUND OF THE DISCLOSURE

Field of the Disclosure

The disclosure relates to sweat absorption devices and more particularly pertains to a new sweat absorption device for protecting headwear from sweat.

SUMMARY OF THE DISCLOSURE

An embodiment of the disclosure meets the needs presented above by generally comprising a clip that is configured to receive a sweatband of a baseball cap or other type of hat. A mount is removably coupled to the clip. An absorbing member is elongated and is positionable on the mount.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
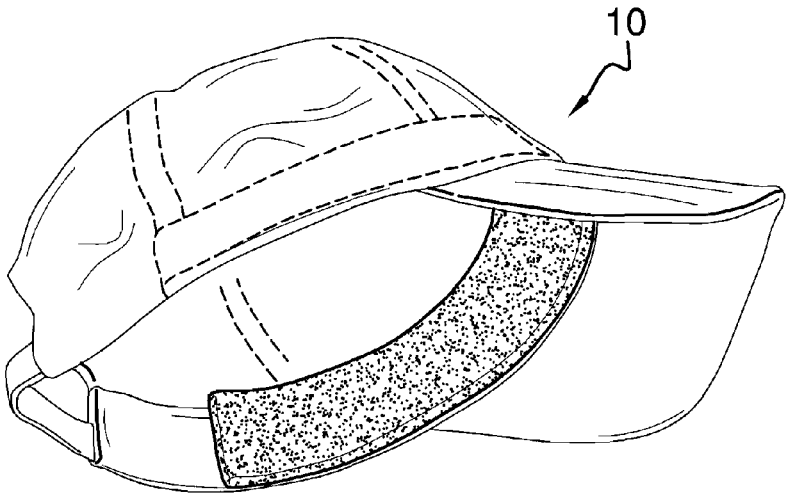
FIG. 1 is a bottom perspective view of a sweat absorption assembly according to an embodiment of the disclosure.
Figure 2:
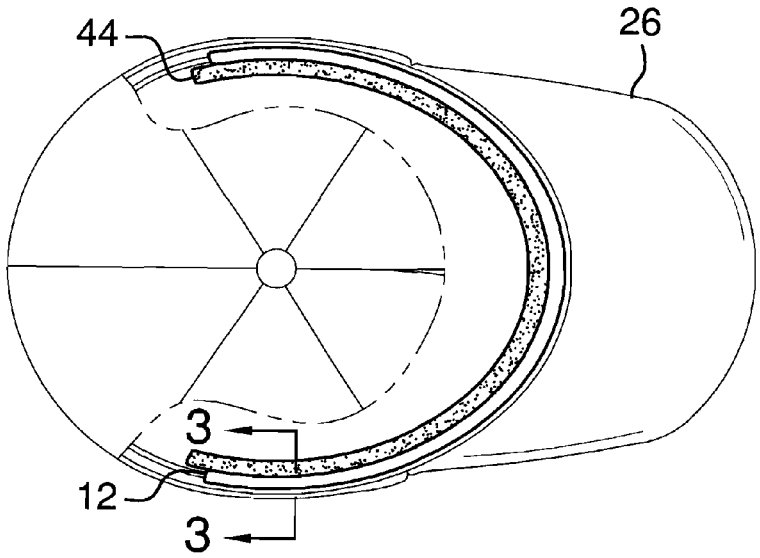
FIG. 2 is a bottom view of an embodiment of the disclosure.
Figure 3:
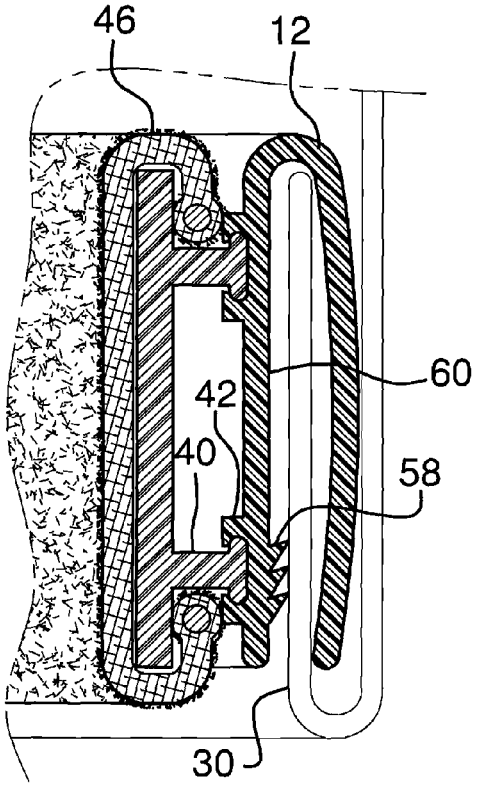
FIG. 3 is a side cutaway view of an embodiment of the disclosure.
Figure 4:
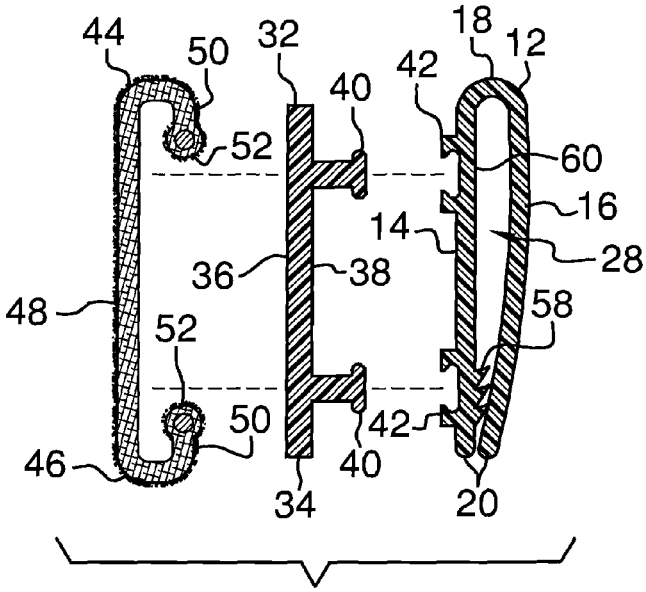
FIG. 4 is a side exploded view of an embodiment of the disclosure.
Figure 5:
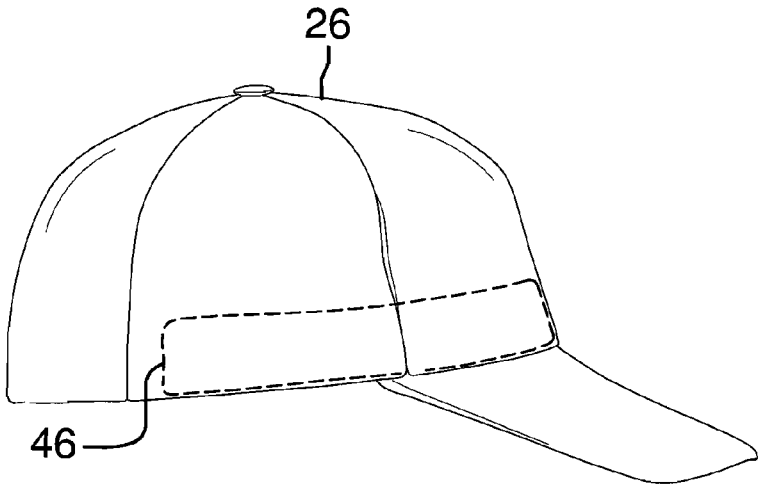
FIG. 5 is a side view of an embodiment of the disclosure.
Figure 6:
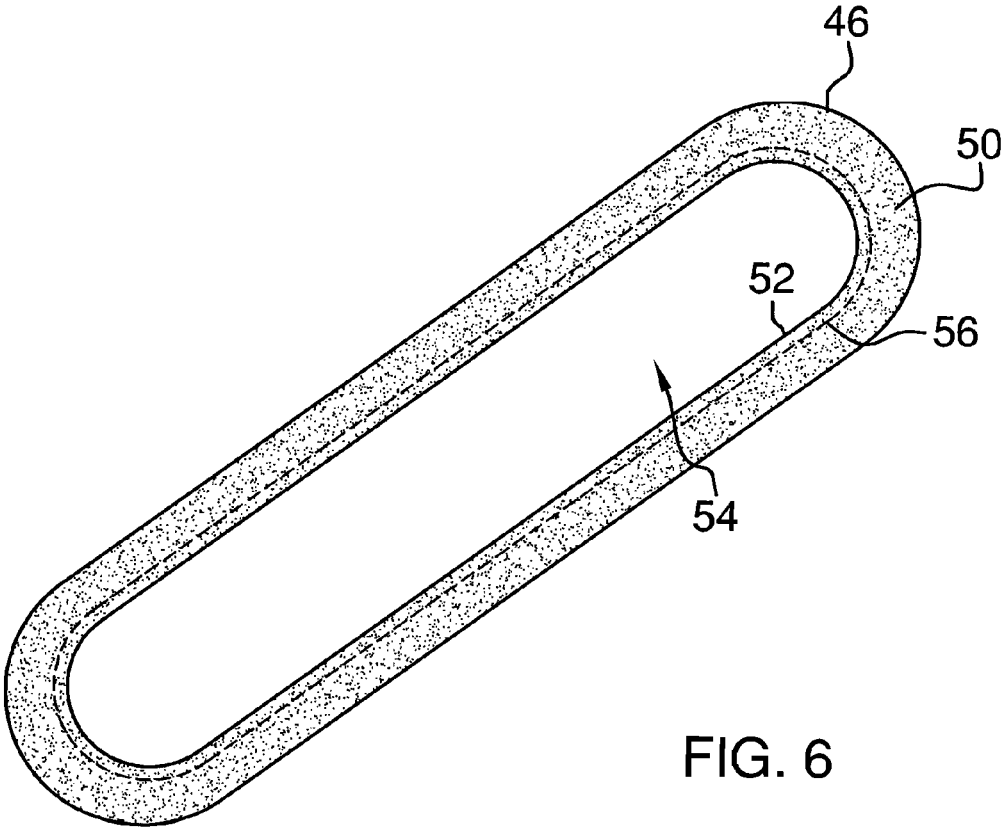
FIG. 6 is a front view of an absorbing member of an embodiment of the disclosure.
Figure 7:
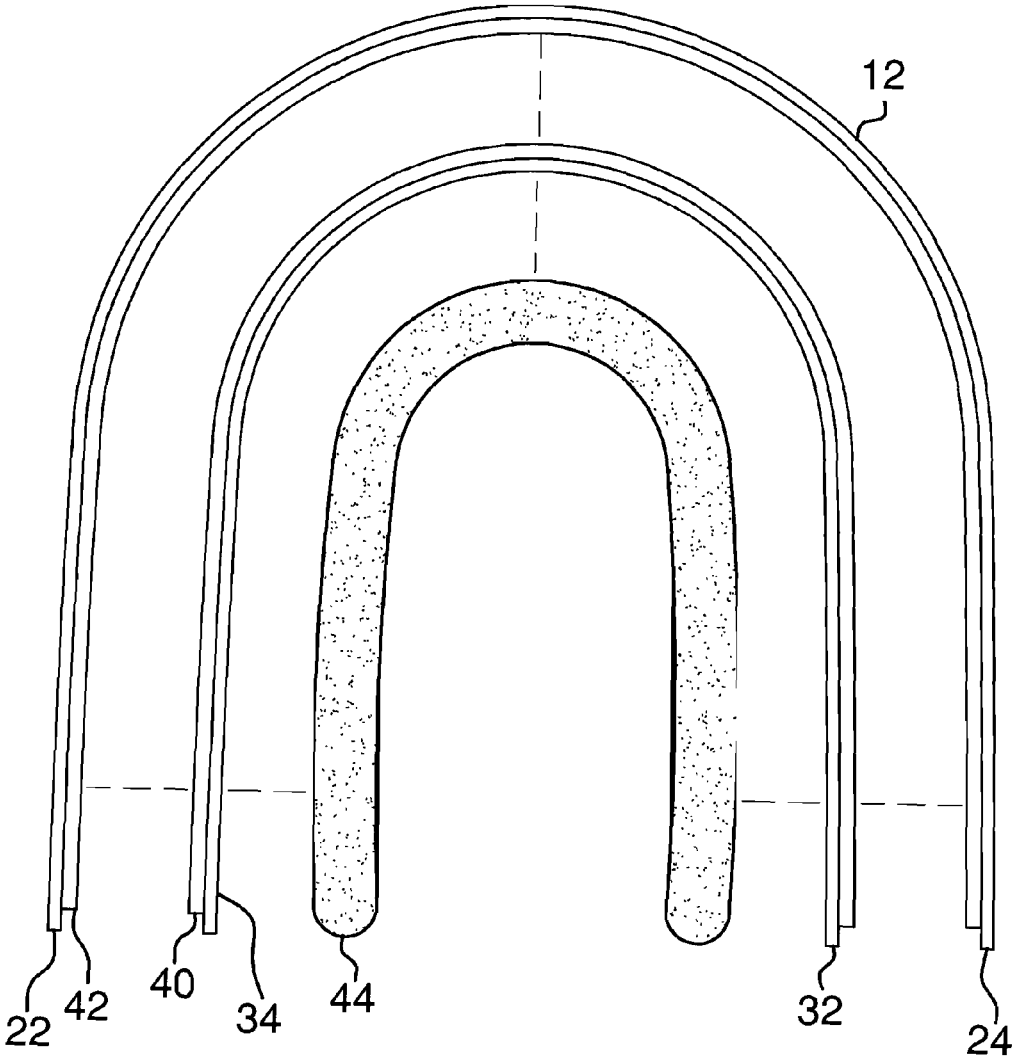
FIG. 7 is a top exploded view of an embodiment of the disclosure.

With reference now to the drawings, and in particular to FIGS. 1 through 7 thereof, a new sweat absorption device embodying the principles and concepts of an embodiment of the disclosure and generally designated by the reference numeral 10 will be described.

As best illustrated in FIGS. 1 through 7, the sweat absorption assembly 10 generally comprises a clip 12 that includes a first panel 14, a second panel 16 and a connector 18 that is attached to the first 14 and second panels 16 such that the first 14 and second panels 16 extend downwardly from the connector 18 and are biased toward each other. Each of the first 14 and second panels 16 has a lower edge 20 positioned distal to the connector 18. Each of the first 14 and second panels 16 has a first end 22 and a second end 24. The first 14 and second panels 16 are arcuate from the first end 22 to the second end 24 for contouring to an interior of a baseball cap 26. A space 28 between the first 14 and second panels 16 is configured to receive a sweatband 30 of the baseball cap 26. While a baseball cap 26 is being shown in the Figures, it should be understood than any type of hat including a sweatband 30 or other structural band may be fitted with the assembly 10.

A mount 32 is provided that is removably coupled to the clip 12. The mount 32 includes a plate 34 that has a first side 36 and a second side 38. A plurality of first mating members 40 is attached to the second side 38. The first panel 14 has a plurality of second mating members 42 attached to it. The first 40 and second mating members 42 are releasably engaged with each other.

An absorbing member 44 is provided that is elongated and is positionable on the mount 32. The absorbing member 44 comprises a sleeve 46 that has an outer wall 48 and a perimeter wall 50 that is attached to the outer wall 48. A free edge 52 of the perimeter wall 50 defines an aperture 54 for receiving the mount 32. An elastic band 56 is attached to the free edge 52. The plate 34 is positionable in the aperture 54 and the elastic band 56 cinches the aperture 54 around the plate 34. A plurality of teeth 58 is attached to an inner surface 60 of the first panel 14 to frictionally engage the sweatband 30. The absorbing member 44 may be comprised of any conventional cloth material used for wicking perspiration.

In use, the clip 12 is installed on the sweatband 30 of a cap 26 by inserting the sweatband 30 into the space 28 between the first 14 and second panels 16. The mount 32 is attached to the clip 12 using the first 40 and second mating members 42. The absorbing member 44 is installed on the mount 32 by inserting the plate 34 into the aperture 54 on the perimeter wall 50 of the absorbing member 44. The elastic band 56 couples the absorbing member 44 to the plate 34. The absorbing member 44 can be removed and reinstalled for cleaning. The assembly 10 may be retrofitted to existing baseball caps 26 or hats or may be integrated into new ones.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A sweat absorption assembly configured for protecting headwear from sweat, said assembly comprising:

a clip configured to receive a sweatband of a hat;

a mount being removably coupled to said clip;

an absorbing member being elongated and being positionable on said mount;

wherein said clip includes a first panel, a second panel and a connector being attached to said first and second panels such that said first and second panels extend downwardly from said connector and said first panel and said second panel are biased toward each other, each of said first and second panels having a lower edge positioned distal to said connector, each of said first and second panels having a first end and a second end, said first and second panels being arcuate from said first end to said second end for contouring to an interior of the hat; and wherein said mount including a plate having a first side and a second side, a plurality of first mating members being attached to said second side, said first panel having a plurality of second mating members thereon, said first and second mating members being releasably engaged with each other.

2. A sweat absorption assembly configured for protecting headwear from sweat, said assembly comprising:

a clip configured to receive a sweatband of a hat;

a mount being removably coupled to said clip;

an absorbing member being elongated and being positionable on said mount; and wherein said absorbing member comprises a sleeve having an outer wall and a perimeter wall being attached to said outer wall, a free edge of said perimeter wall defining an aperture for receiving said mount, an elastic band being attached to said free edge, a plate being positionable in said aperture and said elastic band cinching said aperture around said mount.

3. A sweat absorption assembly configured for protecting headwear from sweat, said assembly comprising:

a clip including a first panel, a second panel and a connector being attached to said first and second panels such that said first and second panels extend downwardly from said connector and are biased toward each other, each of said first and second panels having a lower edge positioned distal to said connector, each of said first and second panels having a first end and a second end, said first and second panels being arcuate from said first end to said second end for contouring to an interior of a baseball cap, a space between said first and second panels being configured to receiving a sweatband of the baseball cap;

a mount being removably coupled to said clip, said mount including a plate having a first side and a second side, a plurality of first mating members being attached to said second side, said first panel having a plurality of second mating members thereon, said first and second mating members being releasably engaged with each other;

an absorbing member being elongated and being positionable on said mount, said absorbing member comprising a sleeve having an outer wall and a perimeter wall being attached to said outer wall, a free edge of said perimeter wall defining an aperture for receiving said mount, an elastic band being attached to said free edge, said plate being positionable in said aperture and said elastic band cinching said aperture around said plate; and a plurality of teeth being attached to an inner surface of said first panel to frictionally engage said sweatband.

* * * * *